US005301809A

United States Patent [19]

Skinner

[11] Patent Number: 5,301,809

[45] Date of Patent: Apr. 12, 1994

[54] SORTING CONVEYOR

[75] Inventor: Karl L. Skinner, Moundridge, Kans.

[73] Assignee: Star Uniform Rental Company, Inc., Ft. Worth, Tex.

[21] Appl. No.: 837,361

[22] Filed: Feb. 14, 1992

[51] Int. Cl.[5] ..... B07C 5/02

[52] U.S. Cl. ..... 209/3.1; 209/583; 209/657; 209/937

[58] Field of Search ..... 209/3.1, 3.3, 583, 657, 209/937; 198/465.4, 687.1, 360, 370

[56] References Cited

U.S. PATENT DOCUMENTS

| | | | |
|---|---|---|---|
| 1,217,986 | 3/1917 | Parre | 209/937 X |
| 2,998,136 | 8/1961 | Gerisch | 209/937 X |
| 3,124,236 | 3/1964 | Gerisch | 198/360 |
| 3,612,250 | 4/1970 | Thompson et al. | 209/3.3 |
| 4,036,365 | 7/1977 | Rosenfeld | 209/937 |
| 4,239,435 | 12/1980 | Weiss et al. | 209/937 X |
| 4,909,373 | 3/1990 | Geerts | 198/465.4 X |
| 4,991,719 | 2/1991 | Butcher et al. | 209/937 X |
| 5,072,822 | 12/1991 | Smith | 209/3.3 X |
| 5,103,737 | 4/1992 | Iwase | 198/360 X |
| 5,125,513 | 6/1992 | Branch | 209/583 X |

FOREIGN PATENT DOCUMENTS

| | | | |
|---|---|---|---|
| 0625977 | 10/1978 | U.S.S.R. | 198/465.4 |

*Primary Examiner*—Robert P. Olszewski
*Assistant Examiner*—Carol Druzbick
*Attorney, Agent, or Firm*—Edward L. Brown, Jr.

[57] ABSTRACT

A sorting conveyor for hanger-supported goods with sorting stations on opposite sides of the conveyor including a track, a moving chain supported by the track with a plurality of hanger pendants extending from the chain for transporting the goods, the pendant having an inclined support bar open in a rearward direction for supporting the hangers, each support station having a pick-off rail extending laterally away from the conveyor to a collection point, the end of each pick-off rail being bent normally to form an engaging probe for passing through and engaging the hook of the moving clothes hanger and tripping the hanger from its pendant onto the pick-off rail and actuator means for moving the engaging probe of each pick-off rail into the path of the clothes hanger hook.

6 Claims, 4 Drawing Sheets

SORTING CONVEYOR

FIELD OF THE INVENTION

The present invention relates to techniques for sorting and arranging items randomly placed on a conveyor, and more particularly, it relates to method and apparatus for efficiently sorting and arranging garments on a sorting conveyor in a selected order determined prior to initiating the sorting process. The compactness and size of the sorting conveyor of the present invention and its modular capability is well suited for applications in the commercial laundry and industrial uniform industry wherein co-mingled identifiable garments are washed and dried, then must be arranged in a selected order for delivery to customers.

BACKGROUND OF THE INVENTION

For numerous decades various material handling methods and techniques have been used for removing items from a conveyor in a selected order. U.S. Pat. No. 3,612,250 discloses a sorting conveyor system for distributing address-coded packages to various sorting stations. U.S. Pat. No. 1,217,988 teaches an early prior art technique for sorting washed laundry which is tagged and placed on a conveyor and dropped therefrom at a selected station. In U.S. Pat. No. 4,036,365 a conveyor system for an industrial laundry sorts garments which are identified and then dropped at stations but not on metal hangers.

In U.S. Pat. No. 4,239,435 a more recent attempt to satisfy the requirements of the commercial laundry industry for sorting and arranging garments is taught. In the '435 patent, hanger-supported garaments are randomly placed on a sorting conveyor which moves along a closed-loop path past a plurality of receiving stations, each receiving station identifies the garment passing thereby and released it at the appropriate station by dropping the hangered garment onto a secondary conveyor by a releasing structure controlled by a rotary solenoid. The apparatus used according to the '435 patent is complex and expensive and the system disclosed has found little acceptance in the commercial laundry industry.

Recent U.S. Pat. No. 4,991,719 teaches another commercial laundry sorting system of randomly positioned items on the sorting conveyor. The computer system which controls this conveyor is complex and drives the conveyor bi-directionally to achieve reduced movement time of the conveyor between drop-off stations. The pick-off mechanism in this patent is a robotic control arm which picks the hangers off the sorting conveyor from only one side and then deposits them on an adjacent unloading conveyor.

While there are sophisticated sorting conveyor systems, as typified in the last two mentioned patents above, the fact remains that practically all commercial laundries still sort manually. Most commercially cleaned garments include a conventional identification marking affixed thereon, and can be readily identified manually or by a bar code reader. The garments are initially sorted by routes which includes various customers. The garments are again sorted and placed on another conveyor grouping the garments by a customer account. A third manual sorting operation is then required to sort all the garments of a particular customer so that they will be grouped for the particular employees of that customer and preferably will be in a selected sequence with respect to garments for other employees of that same customer.

Manual garment sorting as just described has a number of significant drawbacks. First, the accuracy of the manual sorting procedure is a function of human frailties, which in turn means the sorting accuracy is influenced by considerations outside of the commercial laundry employer. Extremely high sorting accuracy is required, since the cost of replacing one of the clean garments improperly sorted and delivered to the wrong customer can practically offset the profits otherwise realized by the laundry for cleaning and sorting 100 other garments. Secondly, manual sorting of garments is very labor intensive as described above, and therefore is a substantial expense factor. In view of the number of repeated sorting operations described above and the multiplicity of conveyors required for each sorting operation, a good deal of floor space is required to perform this operation. The present invention provides a very compact sorting conveyor with twice the number of drop-off stations per lineal foot of conveyor due to the fact that two drop-off stations, one on each side can be located at the same conveyor station. The modular design of the conveyor allows the inclusion of one or more sorting sections to be included in the conveyor thereby allowing a range of drop-off stations from sixteen or multiples thereof.

It is therefore the principal object of the present invention to provide a low cost constant speed sorting conveyor which can accommodate an infinite range of sorting stations.

Another object of the present invention is to provide a constant speed sorting conveyor which has a high density of sorting stations located on both sides of the conveyor.

Another object of the present invention is to provide a constant speed sorting conveyor and has a very simplified transfer mechanism for each sorting station which has a high degree of reliability.

Another object of the present invention is to provide an improved technique for sorting garments on a sorting conveyor wherein the garments are identified by radio transponder devices affixed to the garments.

These and further objects and advantages of the present invention will become apparent from the following detailed description, wherein reference is made to the figures in the accompanying drawings.

and

Figure 5:
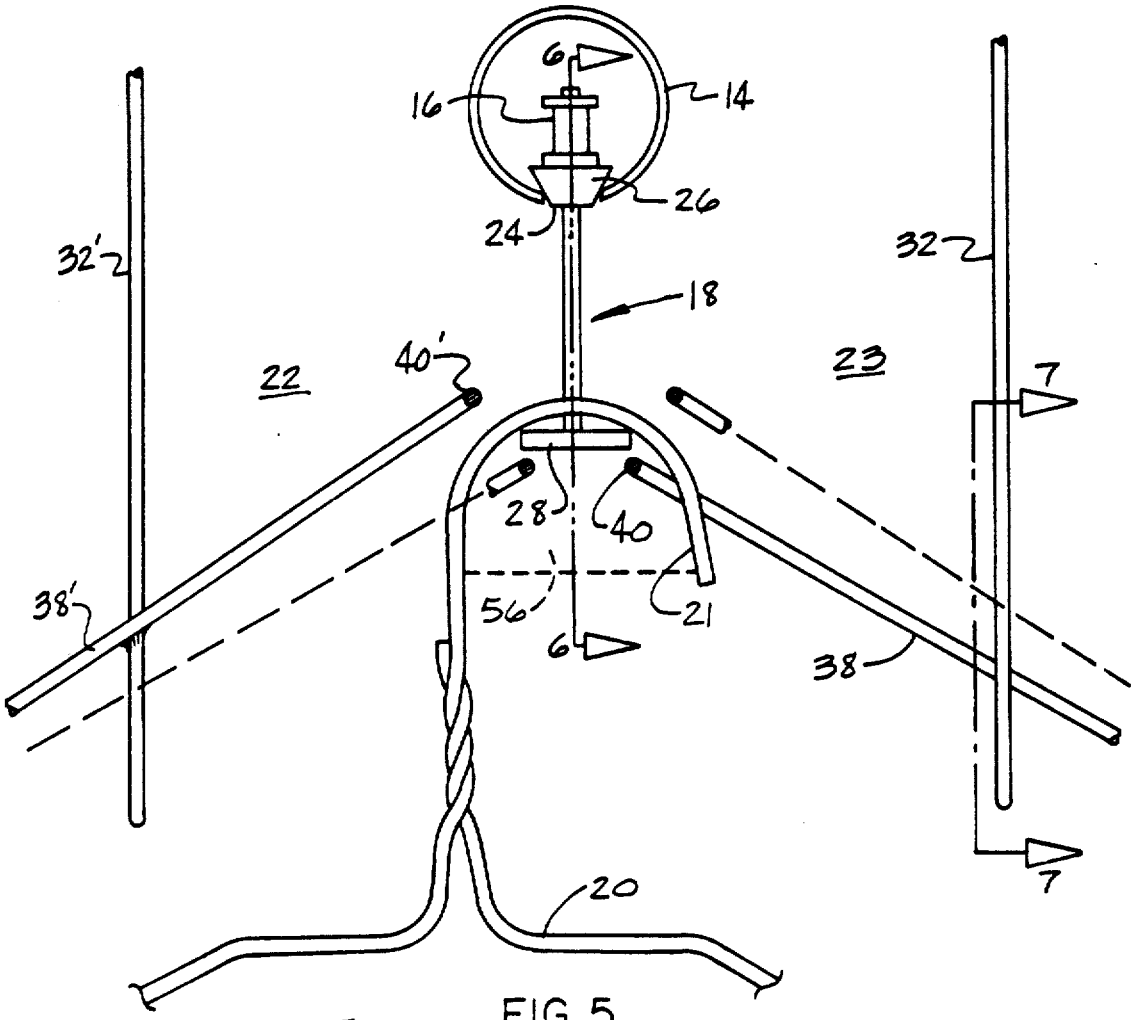
FIG. 5 is an elevational view to an enlarged scale taken along lines 4—4 of FIG. 3 illustrating the clothes supporting hanger hook and the various positions of the engaging probe of the pick-off rail.
Figure 7:
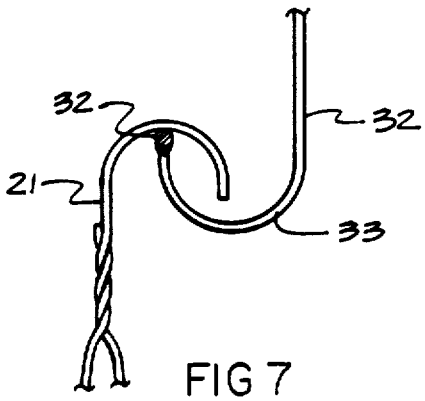

FIG. 7 is a sectional elevational view taken along line 7—7 of FIG. 5 illustrating the connection of the pick-off rail and its actuating rod.

DETAILED DESCRIPTION OF THE PREFERRED EMBODIMENTS

Figure 1:
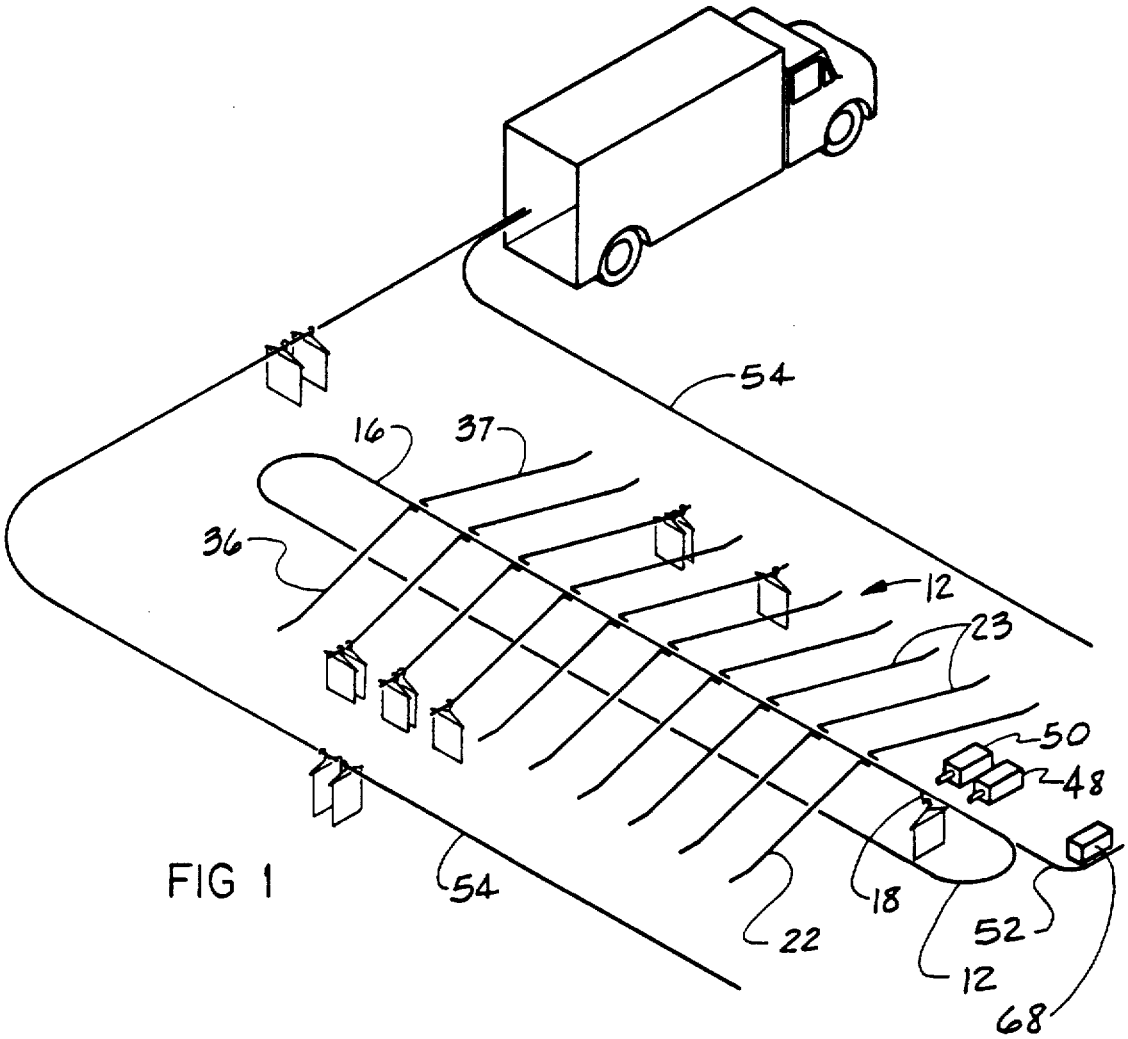
FIG. 1 is an overall perspective schematic view of the sorting conveyor of the present invention showing the plurality of sorting stations and the various associated feed and distribution conveyors.
Figure 2:
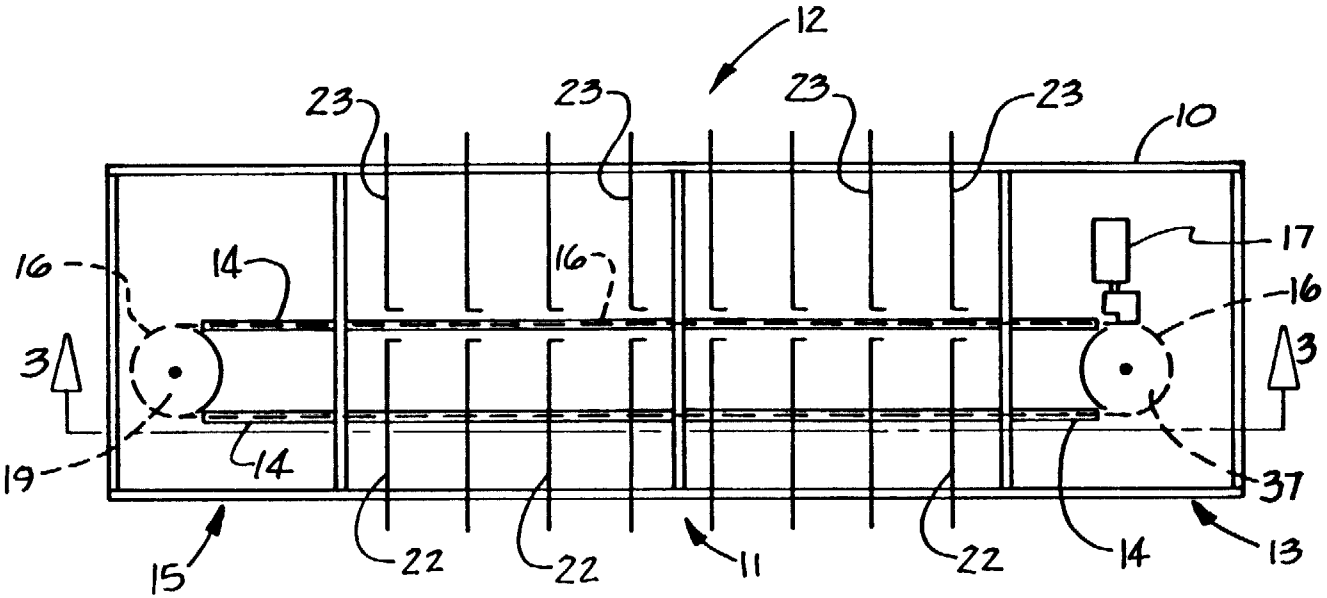
FIG. 2 is a top plan view of the sorting conveyor of the present invention.
Figure 3:
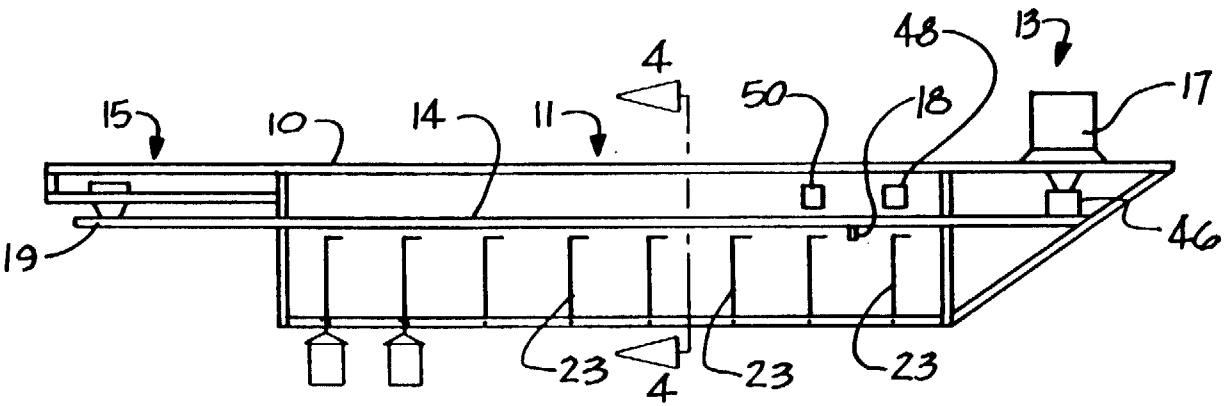
FIG. 3 is a side elevational view taken along line 3—3 of FIG. 2.
Figure 4:
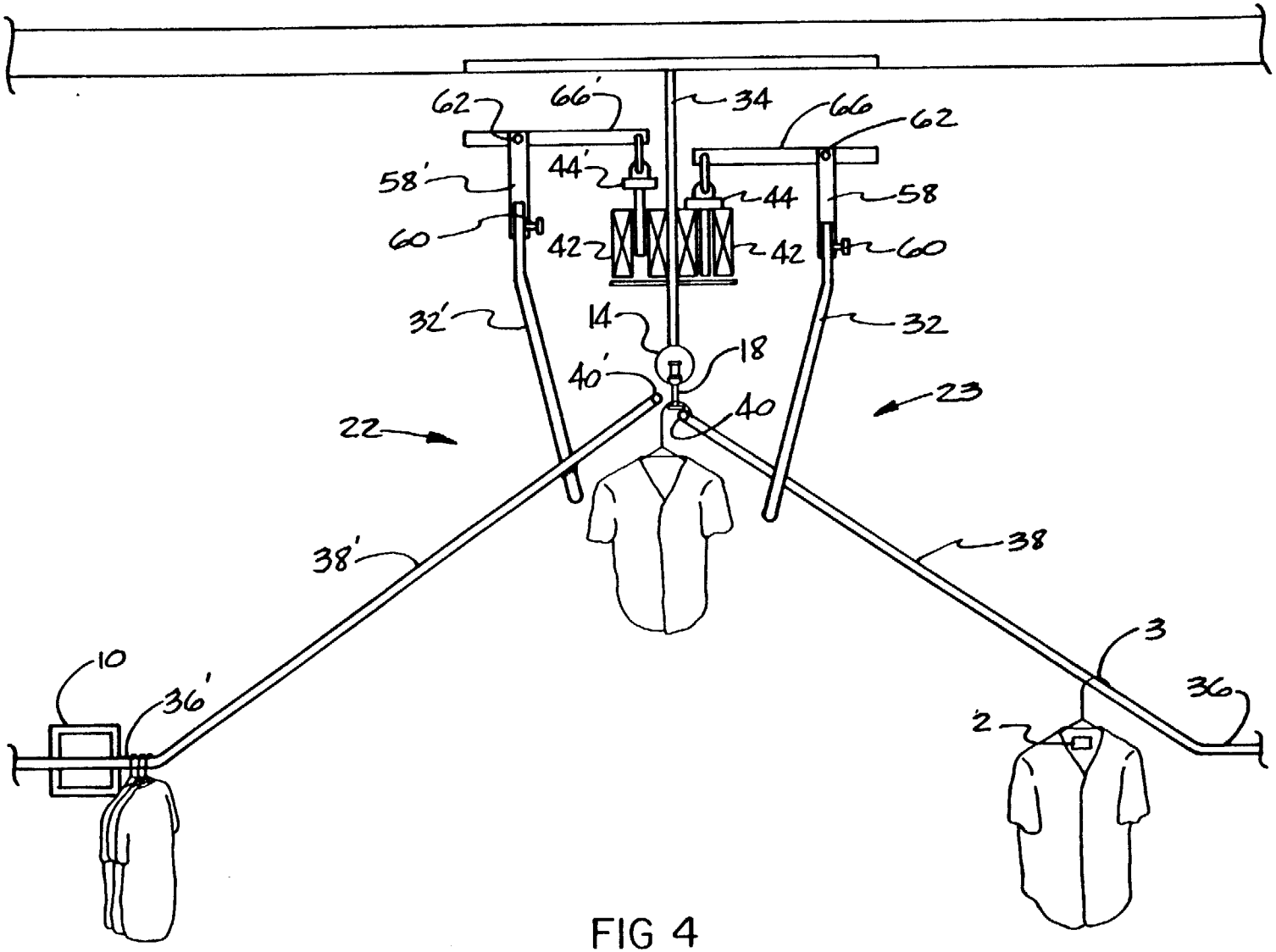
FIG. 4 is a partial elevational view taken along lines 4—4 of FIG. 3 illustrating two adjacent sorting stations.
Figure 6:
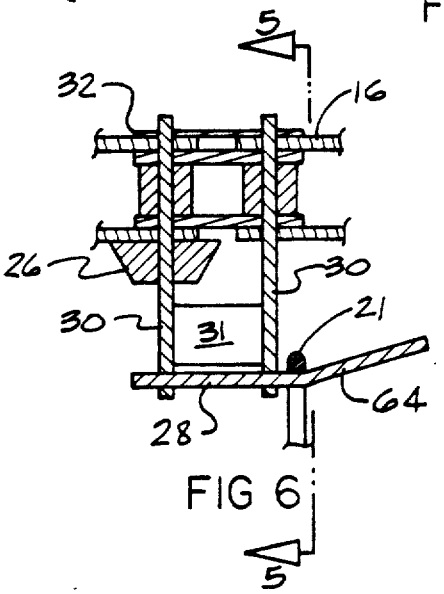
FIG. 6 is a side elevational view to an enlarged scale of the conveyor hanger pendant and a supported hanger.

FIG. 1 depicts the modular sorting conveyor of the present invention generally by reference numeral 12. The system 12 is a constant speed closed loop overhead type conveyor which moves in a single plane as can be seen in FIGS. 2 through 4. The conveyor 12 includes a rectangular support frame 10 which is made up of a drive section 13, an idler section 15 and a sorting section 11, as best seen in FIGS. 2 and 3. While FIGS. 2 and 3 illustrate a single sorting section 11, it is possible to include multiple sections to increase the number of sorting sections to the particular application. Since the conveyor 12 is an overhead conveyor, the frame 10 is suspended from above through any type of suspension structure. The drive section 13 of the conveyor includes a drive motor and gear boxes 17 which in turn powers a drive sprocket 37 for moving a closed loop chain 16. The idler section 15 includes an idler sprocket 19 which supports the opposite end of chain 16 and includes, although not shown in the drawing, an adjustment device for maintaining the drive chain 16 at the correct tension which are well known in the art. The drive sprocket 37 located in drive section 13 of the conveyor includes a safety clutch means 46, as best seen in FIG. 3, which allows the conveyor and motor 17 to stop due to a jamming condition. The revolving drive chain 16 rotates in two track sections 14, as best seen in FIGS. 2 and 5. Track 14 is a round tube with a slot 24 in the bottom thereof through which a plurality of hanger pendants 18 extend, as best seen in FIG. 5. Each hanger pendant 18 comprises a pair of vertically positioned pins 30 separated by a small plate 31. The pins 30 pass up through two adjacent openings in a conventional chain link and are held in place by a conventional clip 32 which engages grooves in the ends of pins 30. Also mounted on one of the pins 30 is a beveled bearing washer 26 which slideably rides in slot 24 of the stationary track or rail 14. Attached to the bottom end of pins 30 is a bar support guide 28 which can be attached by various well known means. Bar support 28 includes a cantilevered end section 64 which is bent upward at a slightly inclined angle, as best seen in FIG. 6 to provide sufficient resistance to a clothes supporting hanger hook 21 supported thereon. The width of support bar 28, as seen in FIG. 5, is roughly half the width of the enclosed area 56 of the hanger hook. The width of the support bar 28 urges the hanger hook 21 in a lateral position relative to the direction of movement of the conveyor.

The conveyor 12, as shown in FIGS. 1 through 3, includes 16 sorting stations 22 and 23 with half of the stations 22 located on the left side, as viewed in FIG. 5, while the remaining eight stations 23 are located on the right side directly opposite stations 22. While the present drawings only illustrate 16 sorting stations, multiple sorting station sections 11 can be added to the conveyor to increase the number of sorting stations to an almost infinite number.

Each sorting station 22 includes a pick-off rail 38', as best seen in FIG. 4, with the end of the rail bent 90° to form an engaging probe 40' which faces the oncoming conveyor. The pick-off rails 38 extend laterally away and downwardly from the conveyor rail 14 so that clothes supporting hangers 20, once riding on the rail 38, will slide by gravity to the lower end of the rail to a storage area 36 wherein the rail includes a horizontal section 36. The lower end of pick-off rail 38 is anchored to the support frame 10, as seen in FIG. 4, with a short extension through the frame member.

The pick-off rails 38 are actuated by individual solenoids 42 mounted directly above the track 14, as best seen in FIG. 4. The core element 44 of the solenoid 42, which moves downwardly when energized, is coupled to a actuating rod 32 for moving the engaging probe 40 into its pick-off position, as seen in FIG. 5 of the drawing. Actuating rod 32 connects to pick-off rail 38, as best seen in FIG. 7, with a welded joint to the bottom surface of the rail. The loop-shaped end 33 of actuator rod 32 allows clothes supporting hangers pass thereover, as shown in FIG. 7, as long as the open side of the hanger hook is on the same side of the rail 38 as is actuator rod 32. As shown in FIG. 5, the actuating rod 32 in sorting station 23, is located in front pick-off rail 38 while in sorting station 22, on the opposite side, actuator rod 32' is located behind pick-off rail 38'.

When the solenoids 42 or 42' are de-energized, the engaging probe 40 and 40' of adjacent sections 22 and 23 are positioned above the enclosed area 56 of the hanger hook, as shown in FIG. 5 in solid line at station 22 and in dotted line in station 23. The cantilevered mounting of pick-off rails 38 in frame member 10 maintains the ends of rails 38 in their elevated and inoperative position. When the solenoids 42 and 42' are actuated, the engaging probe end 40 of each pick-off rail is pulled downward by its actuator rod 32 to the hook-engaging or pick-off positions illustrated in the drawing.

Actuator rod 32 has at its upper end, as shown in FIG. 4, an adjustable sleeve member 58 which includes set screws 60 and 62 for adjusting the rigging or positioning of the engaging probe 40. A secondary actuating rod 66 passes laterally through sleeve 58 and is anchored in place by set screw 62. The inner end of rod 66 is connected by a link member to the solenoid core 44. The positioning of engaging probe 40 either inside or out of the enclosed area 56 of the hanger hook requires precise adjustment on the actuating structure for pick-off rail 38 and the solenoid core 44. This is achieved by the adjustment of set screws 62 and 60 which in effect vary the length of rods 32 and 66.

OPERATION

In a commercial laundry, garments such as pants and shirts of various types are washed together including garments from other customers and possible other routes. After a batch of laundry of this nature is laundered and pressed, they are placed on hangers in random order on feed conveyor 52, as best seen in FIG. 1. The sorting operation of these random industrial garments must first be separated by route, then customer account, and then by the particular employee of that customer. The various sorting stations for each employee must be in a particular order and the garments for a particular company must be in a particular order for the delivery driver who picks up the garments off of the distribution conveyor 54 and loads them in his truck. They all must be in proper sequence so that the last garments into the truck go to the first stop on the drivers route and then the following garments are in order for each route stop that is made. Typically, a delivery route might include 15 companies with a total of 90 employees for all of the 15 companies combined. With the present invention only a single sort is necessary since there are can be at least 90 sorting stations on the conveyor 12. Each garment will be supported on its own wire hanger and will include a bar code identification marking, or a transponder radio device permanently sewn within the garment. Garments can also utilize suitable temporary tags which are fixed to the garments and then removed prior to delivery. However, this method is obviously more time consuming than the permanently attached marking.

After each garment has been cleaned, dried and pressed, it is placed on a metal hanger. The garment will remain on that hanger during the sorting and delivery process until the employee utilizes the garment.

The garments are placed in random order on the feed conveyor 52 which feeds them either automatically or manually onto sorting conveyor 12, as seen in the drawing. As each hangered garment passes a laser scanner 68, the identification of the clothing, company and employee is recorded by the computer in a set sequence as the garments enter the sorting conveyor 12. The hanger pendants 18 on the moving chain 16 are equally spaced and when each garment passes a first sensor 48, the computer records how many garments have passed. Also, the computer records how many pendants have passed sensor 50. Since the hanger pendants 18 are equally spaced on chain 16 the computer knows the random sequence of items including any empty pendants, when a particular garment reaches its particular sorting station, the computer will signal that station by energizing its solenoid and pick-off the garment and hanger and allowing it to slide by gravity down rail 38 to its storage area 36.

To understand the manner in which the sorting stations 22 and 23 function, attention is specifically directed to FIGS. 4 and 5.

Since the computer knows the sequence of garments on the conveyor and the number of hanger pendants which have passed the sensor 50, it knows where each randomly placed garment is with respect to its particular sorting station. When it reaches that station, the transfer mechanism is actuated by the computer and the garment is removed from its respective hanger pendant.

FIG. 5 illustrates two adjacent sorting stations 22 and 23 with station 22 de-energized and station 23 energized. As each hangered garment approaches its proper sorting station, the computer would fire solenoid 42 causing engaging probe 40 to move from its dotted line position to its full line position, as shown in FIG. 5, aligned within the enclosed area 56 of the hanger hook. Since the conveyor continuously moves, the engaging probe 40 and its pick-off rail 38 will intercept the open side of hook 21 and cause it to slide off of the back of bar support 28. Bar support 28 at its free end has a slight upward slope to prevent the hanger from slipping off the end of the bar without a defined horizontal force. As pick-off rail 38 trips one side of the hanger hook 21, the hanger will tend to cock sideways as it slips off the end of bar 28 and lands on the inclined surface of rail 38. Hanger 20, due to gravity, then slides down pick-off rail 38 to its storage area 36. The unique geometry of the pick-off rail and its engaging probe allows the pick-off rail to trip the hanger on either its open or closed side of the hook. Station 22, as shown in FIG. 5, is not energized and probe 40' is shown in full line above the enclosed area 56 of the hook. When a garment is about to pass sorting station 22, as shown in FIG. 5, the computer will fire solenoid 42' and cause solenoid core member 44' to move downwardly from its FIG. 4 position whereby actuating rods 66' and 32' will bend pick-off rail 38' downward to its dotted line position within the enclosed area 56 of the hanger hook, as shown in dotted line in the drawing. As the hanger hook 21 falls off of support bar 28, the hanger will be cocked in the opposite direction as in station 23 as it begins to slide down pick-off rail 38' with the free end of hook 21 on the far side of pick-off rail 38. Since the open end of the hanger hook is now on the opposite side of pick-off rail 38', the actuating rod rod 32' is located behind rail 38 rather than in front of rail 38, as in station 23.

After all of the random garments have been dropped on their respective sorting stations 22 or 23, they are manually gathered and placed on distribution conveyor 54 in the same order the sorting stations are positioned on the sorting conveyor 12. The garments remain in that order and are placed in the delivery truck whereby the driver follows a pre-planned route and withdraws the garments from the delivery truck in the same sequence they are placed in the truck. Typically, the last sorting station on the conveyor remains in a pick-off position so that any items which were not previously dropped at the various sorting stations will be gathered at this last station and withdrawn from the sorting conveyor 12.

If a radio transponder is used in each garment in place of a bar code label, an appropriate type of scanner will be used to identify all of the same information.

Other alternative forms of the present invention will suggest themselves from apparatus and methods described herein. Accordingly it should be understood that the apparatus as described herein and shown in the accompanying drawings are intended as exemplary embodiments of the present invention, and not as limitations thereto.

What is claimed is:

1. A sorting conveyor for hanger supported goods on conventional clothes hangers having a hook thereon, the conveyor having a plurality of sorting stations on opposite sides of the conveyor including:

a track;

a moving chain moving in a forward direction defining a conveyor path supported by the track with a plurality of hanger pendant means extending therefrom for supporting and transporting goods by conventional clothes hangers the pendant means including a support bar open in a rearward direction;

at least one pair of sorting stations juxtaposed to each other on opposite sides of the conveyor; each station having a pick-off rail extending laterally away from the conveyor to a collection point, each pick-off rail being bent normally to form an engaging probe for passing through and engaging the hook of a moving clothes clothes hanger and tripping the hanger from its support bar onto the pick-off rail; and actuating means for moving the engaging probe of each pick-off rail into the conveyor path of a clothes hanger hook.

2. A sorting conveyor as set forth in claim 1, including: a beginning station on the conveyor, sensing means at the beginning station which identifies the goods on each hanger pendant means and an order of passage of each identified goods, and computer means which takes the data from the sensing means and signals a proper sorting station for pick-up when each goods passes the proper sorting station and the actuating means is a solenoid.

3. A sorting conveyor as set forth in claim 2, wherein the sensing means is a laser scanner which reads a bar code label on the goods.

4. A sorting conveyor as set forth in claim 2 further including a radio transponder means fixed in each goods item which is identified by the sensing means.

5. A sorting conveyor as set forth in claim 1, wherein the support bar is inclined and has sufficient width to maintain the hook of the hanger in a substantially lateral position relative to the track.

6. A sorting conveyor for conventional clothes hanger supported goods, each convention clothes hanger having a hook, with a plurality of sorting stations on opposite sides of the conveyor including:

a track;

a moving chain moving in a forward direction defining a conveyor path supported by the track, a plurality of hanger pendant means extending from the chain for supporting and transporting conventional clothes hangers to the sorting stations, the pendant means including an inclined support bar open in a rearward direction;

a plurality of sorting stations on opposite sides of the conveyor; each station having a pick-off rail extending substantially laterally away from the conveyor to a collection point, each pick-off rail having an engaging probe means for passing through and engaging the moving clothes hanger on either side of the clothes hanger hook and tripping the clothes hanger from its pendant onto the pick-off rail; and actuating means for moving the engaging probe of each pick-off rail into and out of the conveyor path of the clothes hanger hook.

* * * * *

UNITED STATES PATENT OFFICE

CERTIFICATE OF CORRECTION

Patent No. 5,301,809 Dated April 12, 1994

Inventor(s) KARL R. SKINNER

It is certified that error appears in the above-identified patent and that said Letters Patent is hereby corrected as shown below:
On title page, Item [75]:
Middle initial of inventor should be "R".

Signed and Sealed this

Twenty-sixth Day of July, 1994

Bruce Lehman

*Attest:*

BRUCE LEHMAN

*Attesting Officer*

*Commissioner of Patents and Trademarks*